US008234900B1

(12) United States Patent
Wang

(10) Patent No.: US 8,234,900 B1
(45) Date of Patent: Aug. 7, 2012

(54) CORRUGATED METAL SHEET MEMBER FABRICATION SYSTEM

(76) Inventor: Tsai-Shen Wang, Taipei Hsien (TW)

( * ) Notice: Subject to any disclaimer, the term of this patent is extended or adjusted under 35 U.S.C. 154(b) by 405 days.

(21) Appl. No.: 12/717,312

(22) Filed: Mar. 4, 2010

(51) Int. Cl.
*B21D 28/26* (2006.01)

(52) U.S. Cl. ..... 72/302

(58) Field of Classification Search ..... 72/203, 72/204, 224, 225
See application file for complete search history.

(56) References Cited

U.S. PATENT DOCUMENTS 6,983,837 B1 * 1/2006 Chen ..... 198/466.1
7,207,201 B1 * 4/2007 Chuang ..... 72/131
7,779,663 B1 * 8/2010 Chen ..... 72/385
* cited by examiner

*Primary Examiner* — Faye Francis
(74) *Attorney, Agent, or Firm* — Jackson IPG PLLC

(57) ABSTRACT

A corrugated metal sheet member fabrication system in which the roller ramming unit includes a flange-forming roller set located on the machine base near the rear side for ramming a part of a second lateral corrugated portion of each corrugated metal sheet member processed by a roller ramming unit opposite to a first lateral corrugated portion of the respective corrugated metal sheet member into an inwardly protruding bottom flange, a flange cutting tool located on the machine base behind the flange-forming roller set for cutting the inwardly protruding bottom flange subject to the desired length and shape, a stamping mold located on the machine base between the flange cutting tool and the cut-off unit for stamping the first lateral corrugated portion of each corrugated metal sheet member into a transversely curved profile having a longitudinal groove and simultaneously stamping each corrugated metal sheet member into a stepped configuration.

1 Claim, 13 Drawing Sheets

CORRUGATED METAL SHEET MEMBER FABRICATION SYSTEM

BACKGROUND OF THE INVENTION

1. Field of the Invention

The present invention relates to the fabrication of corrugated metal sheet member and more particularly, to a corrugated metal sheet member fabrication system, which is practical for mass production of corrugated metal sheet members, enabling finished corrugated metal sheet members to be overlapped one another steadily during installation.

2. Description of the Related Art

During fabrication of corrugated metal sheet members through a conventional corrugated metal sheet member fabrication system, a metal sheet material 8 is let off from a metal sheet reel through an entry guide into a roller ramming unit on a machine base and roller-rammed by roller sets of the roller ramming unit into a corrugated portions 81;82;83, and then the corrugated metal sheet material is properly cut by a cut-off unit into corrugated metal sheet members subject to the desired size (see FIG. 1), and them stamped by a stamping mold into a stepped configuration 84 (see FIG. 2). A corrugated metal sheet member 8' made according to this method has a plurality of corrugated portions 81';82';83' (see FIG. 3), a lateral edge at one side of one lateral corrugated portion 82, dents (not shown) or through holes 821 located on the lateral edge (see FIG. 4A). The finished corrugated metal sheet members 8 are transferred backwards by a conveying unit 5 at the rear side of the machine base 3 for further collection. When corrugated metal sheet members 8' are mounted on the roof of a building, one lateral corrugated portion 82' of one corrugated metal sheet member 8' is overlapped on one lateral corrugated portion 83' of another corrugated metal sheet member 8', and the stepped configurations 84' of each two adjacent corrugated metal sheet members 8' are attached together (see FIG. 4B). Further, screws 91 are inserted the through holes 821' of the corrugated metal sheet members 8' and driven into the steel frame 92 at the roof of the building (see FIG. 4A). When two corrugated metal sheet members 8' are overlapped together, the stepped configurations 84' of the two overlapped corrugated metal sheet members 8' tend to be forced apart upon a strong wind, loosening the installation stability.

Therefore, it is desirable to provide a corrugated sheet member fabrication system, which eliminates the aforesaid problem.

SUMMARY OF THE INVENTION

The present invention has been accomplished under the circumstances in view. It is therefore the main object of the present invention to provide a corrugated metal sheet member fabrication system, which enables each two finished corrugated metal sheet members to be overlapped stably.

It is another object of the present invention to provide a corrugated metal sheet member fabrication system, which simplifies the fabrication of corrugated metal sheet members, facilitating mass production.

It is still another object of the present invention to provide a corrugated metal sheet member fabrication system, which enables the finished corrugated metal sheet member to provide a transversely curved profile, thereby reinforcing the structural strength.

DETAILED DESCRIPTION OF THE INVENTION

Figure 1:
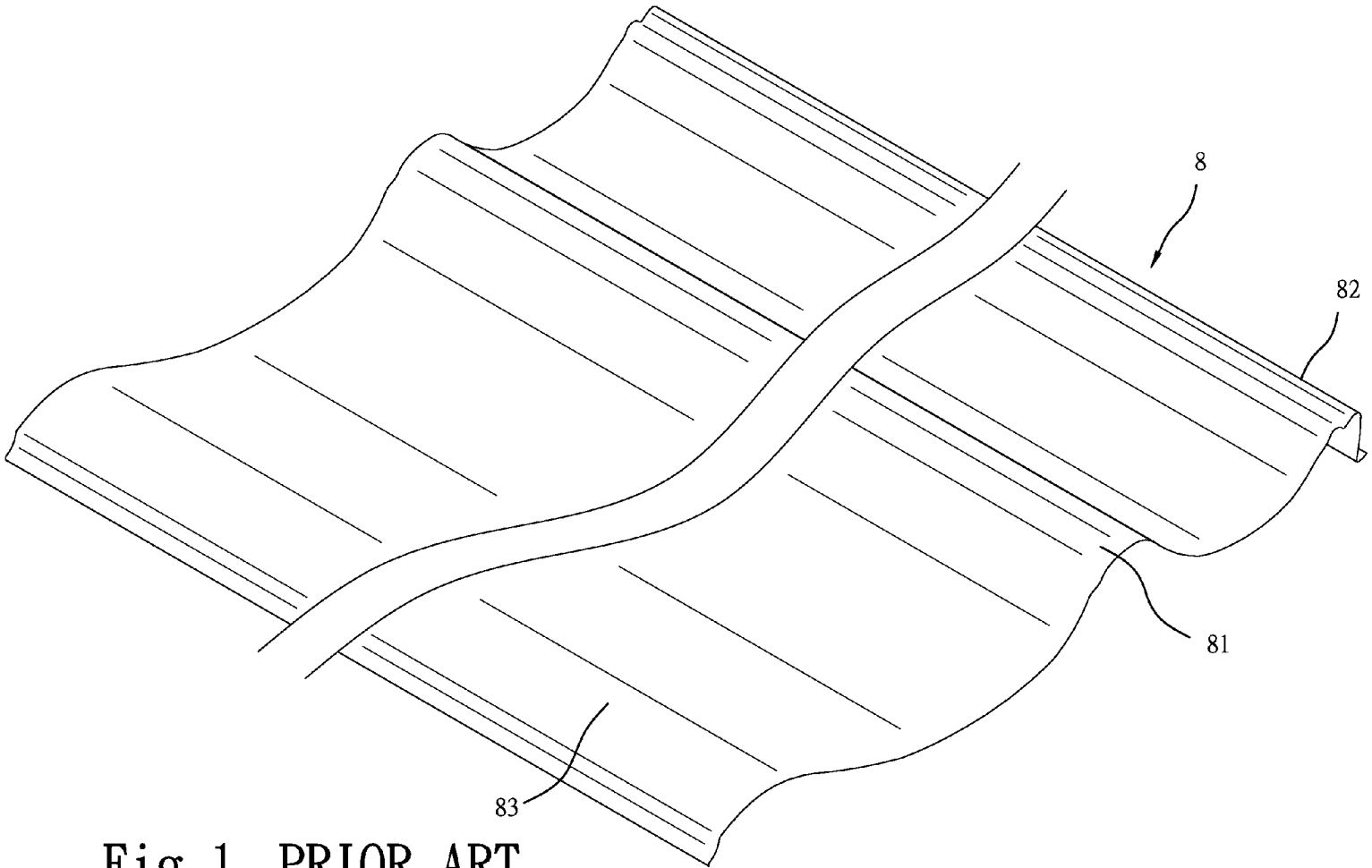
Fig. 1 PRIOR ART
FIG. 1 illustrates a metal sheet member processed into a corrugated metal sheet member made according to the prior art.
Figure 2:
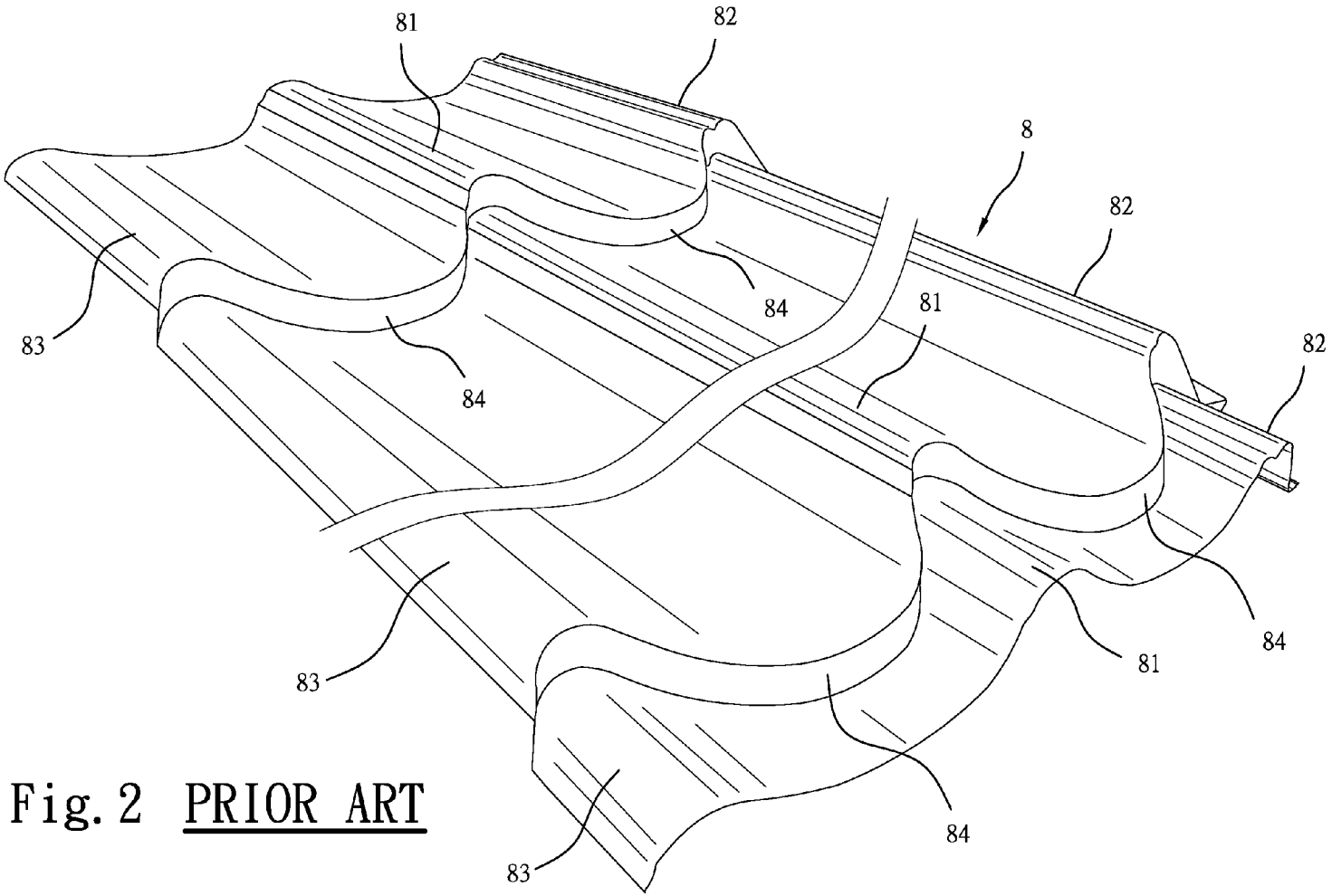
Fig. 2 PRIOR ART
FIG. 2 illustrates the corrugated metal sheet member of FIG. 1 processed into a stepped configuration according to the prior art.
Figure 3:
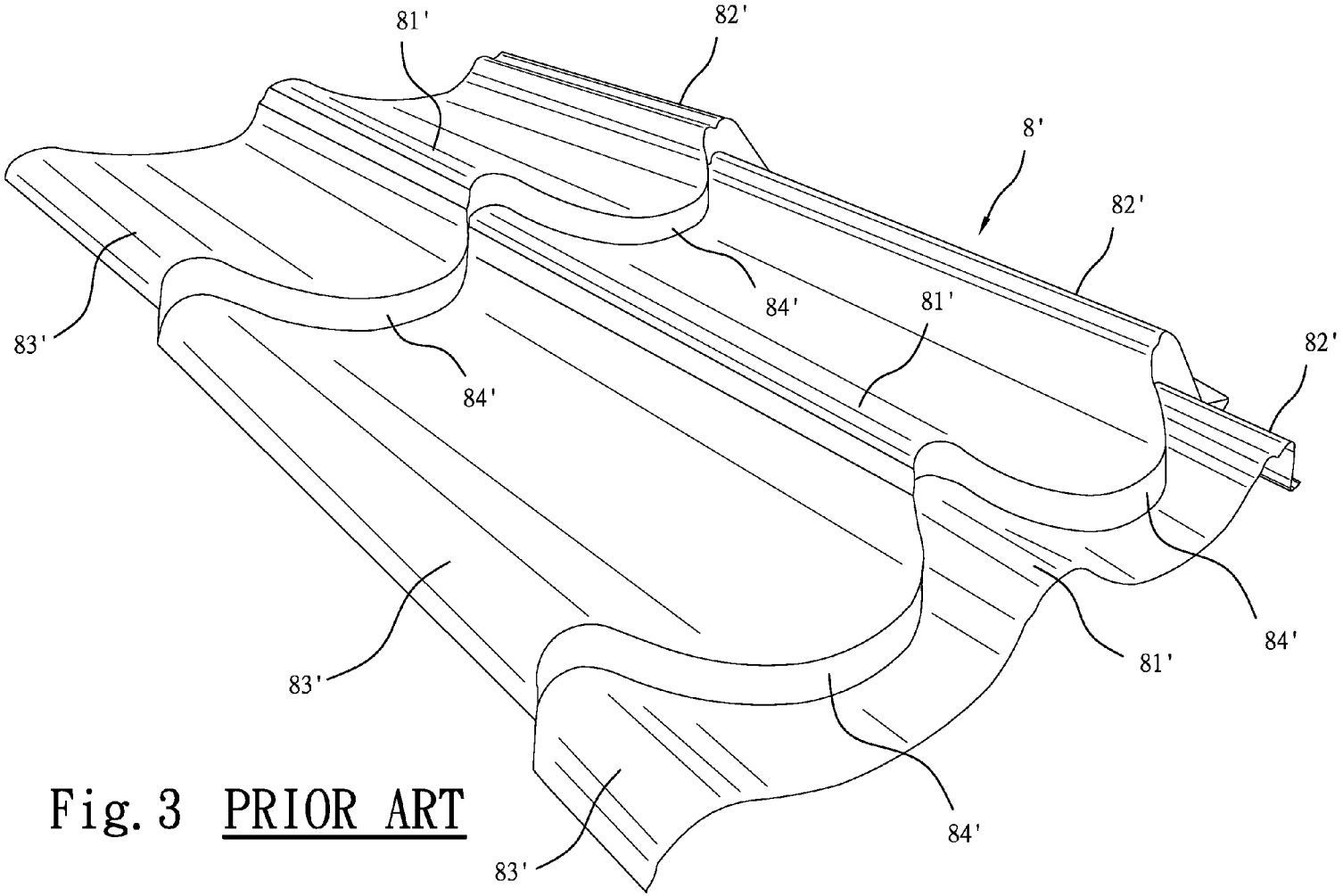
Fig. 3 PRIOR ART
FIG. 3 is an elevational view of a finished corrugated metal sheet member according to the prior art.
Figure 4A:
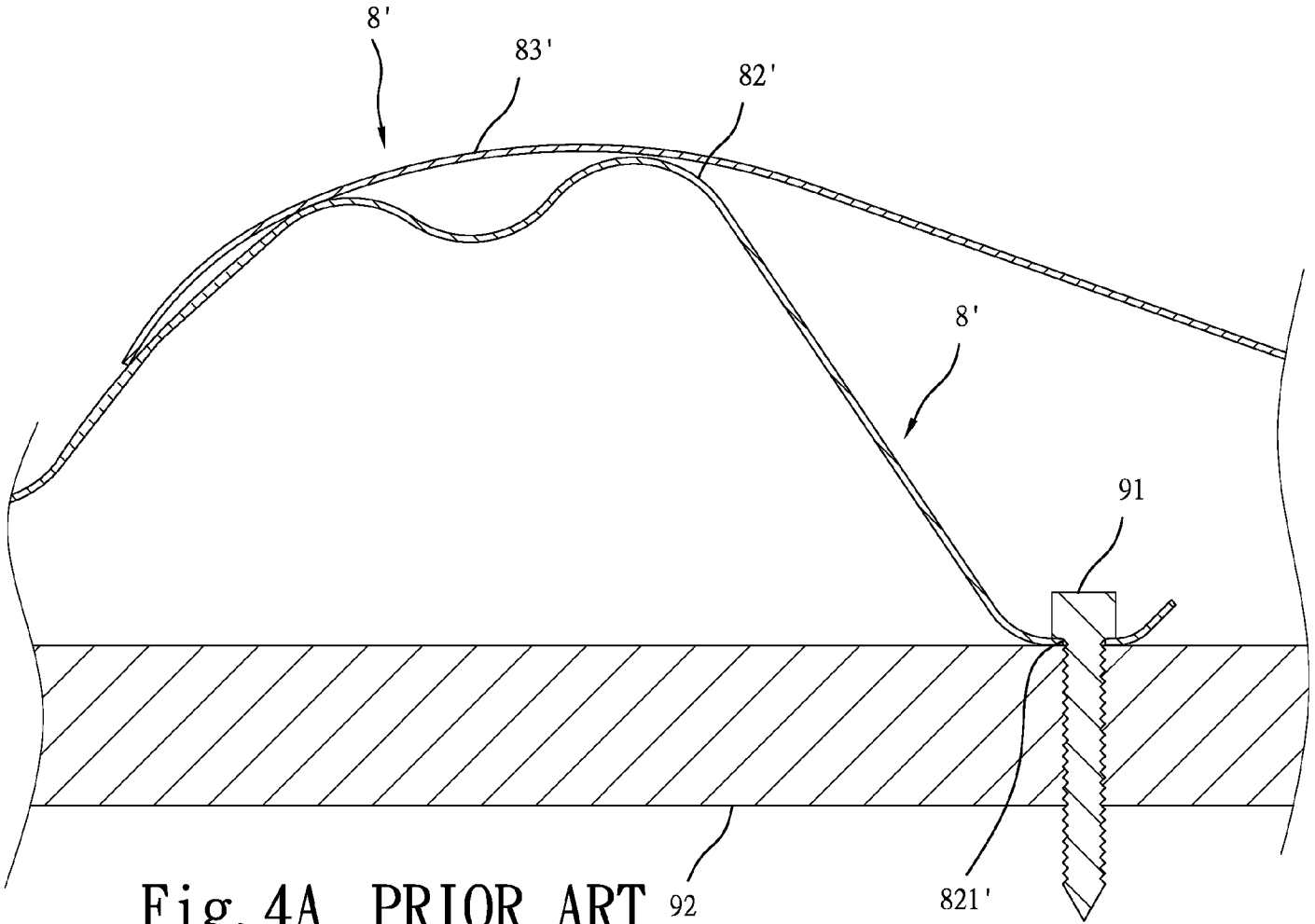
Fig. 4A PRIOR ART
FIG. 4A is a schematic sectional view showing two finished metal sheet members attached together on a roof according to the prior art.
Figure 4B:
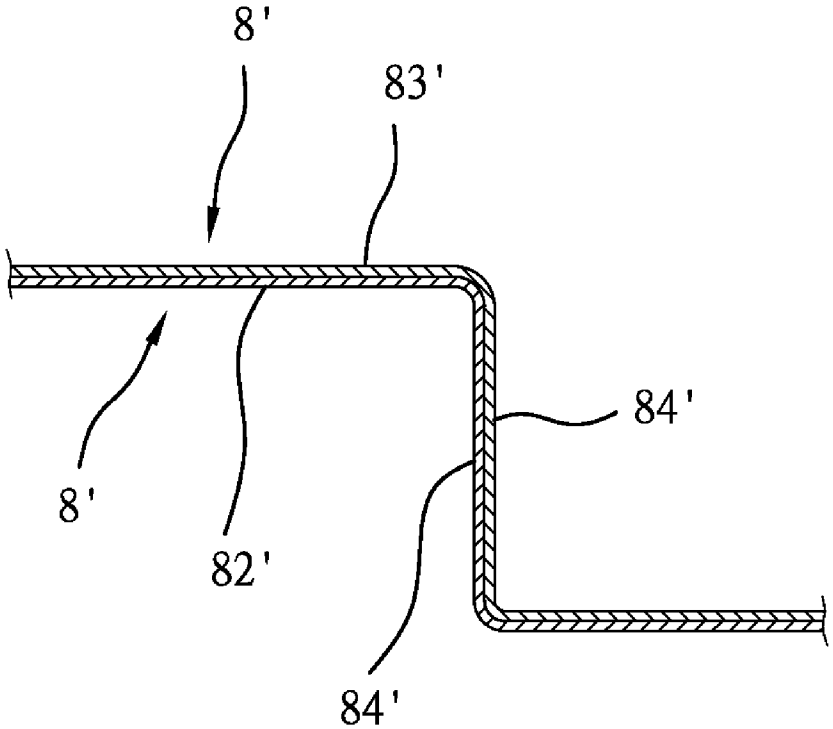
Fig. 4B PRIOR ART
FIG. 4B is a sectional view of an overlapped part of two finished corrugated metal sheet members according to the prior art.
Figure 5:
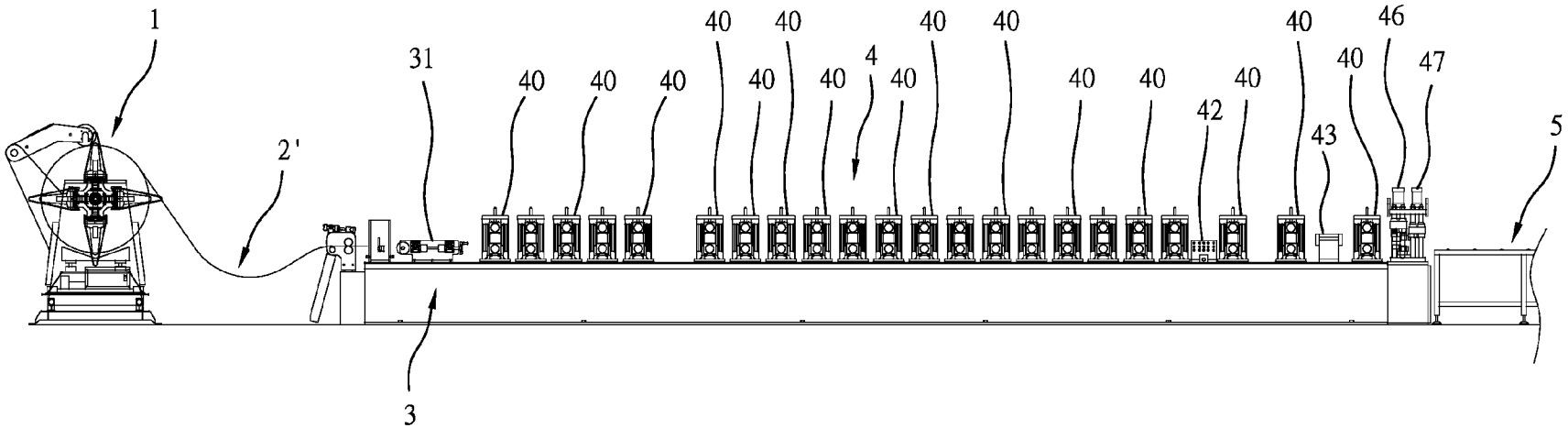
FIG. 5 is a schematic side plain view of a corrugated metal sheet member fabrication system according to the present invention.
Figure 6:
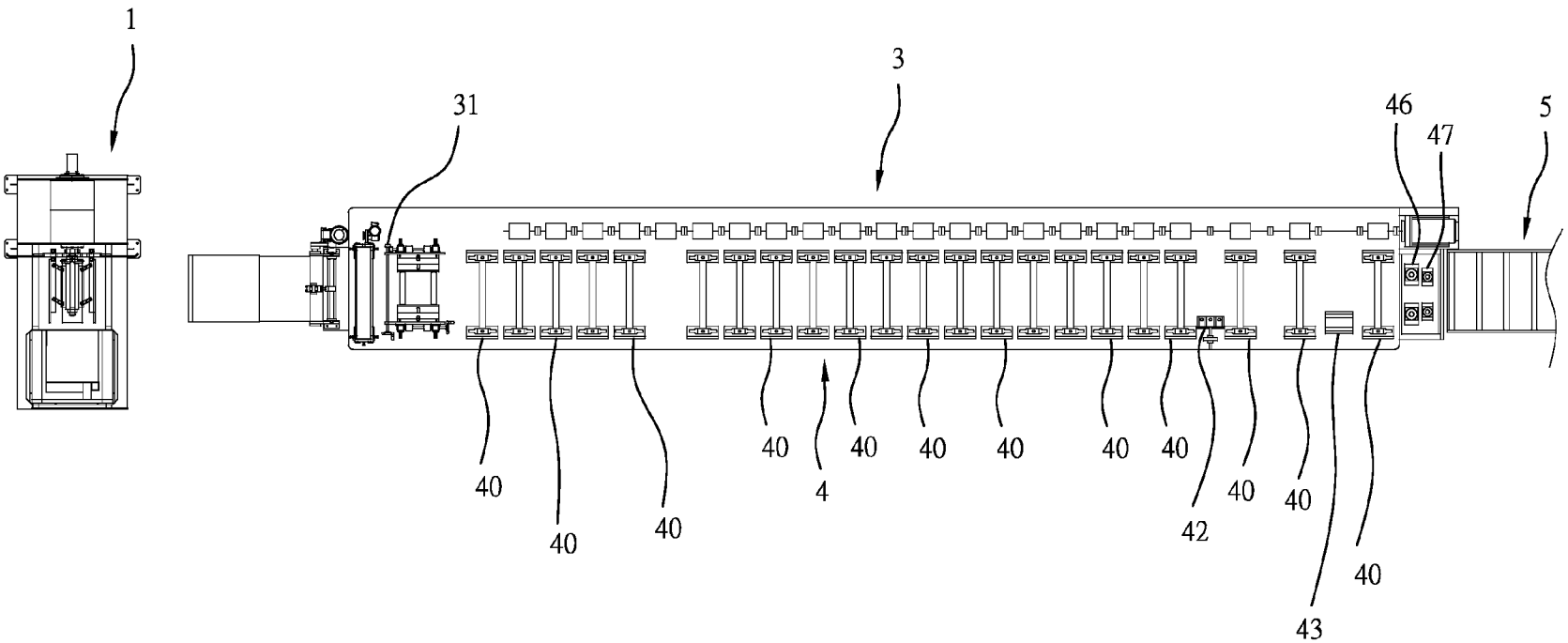
FIG. 6 is a schematic top plain view of the corrugated metal sheet member fabrication system according to the present invention.
Figure 7:
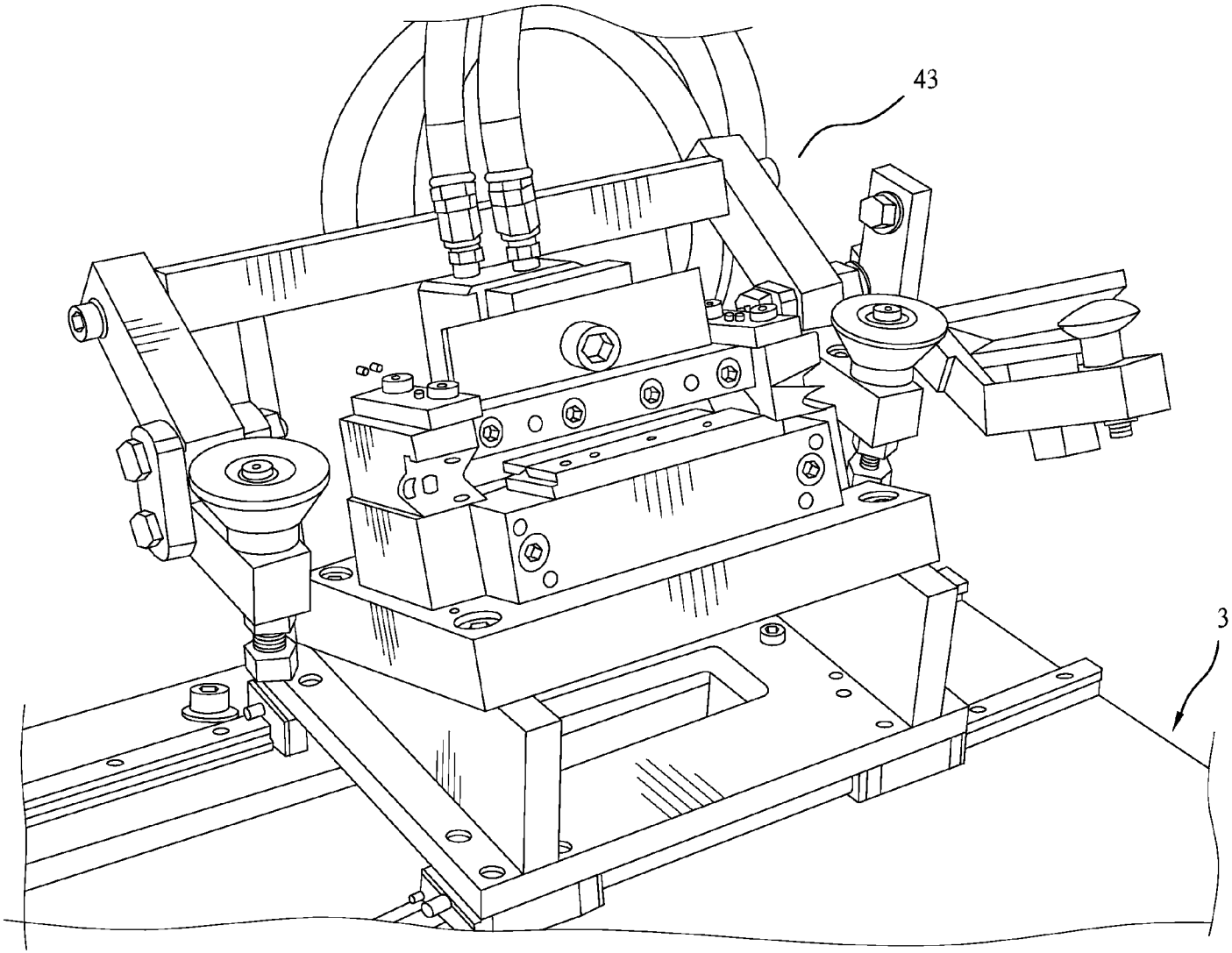
FIG. 7 is an elevational view of a part of the corrugated metal sheet member fabrication system according to the present invention, showing the structure of the flange cutting tool.

Referring to FIGS. 5~12, a corrugated metal sheet member fabrication system of the invention enables finished corrugated metal sheet members to be connected together positively during application.

Metal sheet material 2' is let off from a metal sheet reel 1 through an entry guide 31 into a roller ramming unit 4 on a machine base 3 and roller-rammed by roller sets 40 of the roller ramming unit 4 into a corrugated form, and then the corrugated metal sheet material 2' is properly cut by the cut-off unit 47 into corrugated metal sheet members 2 (see FIG. 8) subject to the desired size. A corrugated metal sheet member 2 made according to this method has a plurality of corrugated portions 21;22;23, a lateral edge 222 at one side of one lateral corrugated portion 22 (see FIGS. 8, 9 and 11), dents (not shown) or through holes 2221 located on the lateral edge 222 (see FIG. 11). The finished corrugated metal sheet members 2 are transferred backwards by a conveying unit 5 at the rear side of the machine base 3 for further collection.

Figure 8:
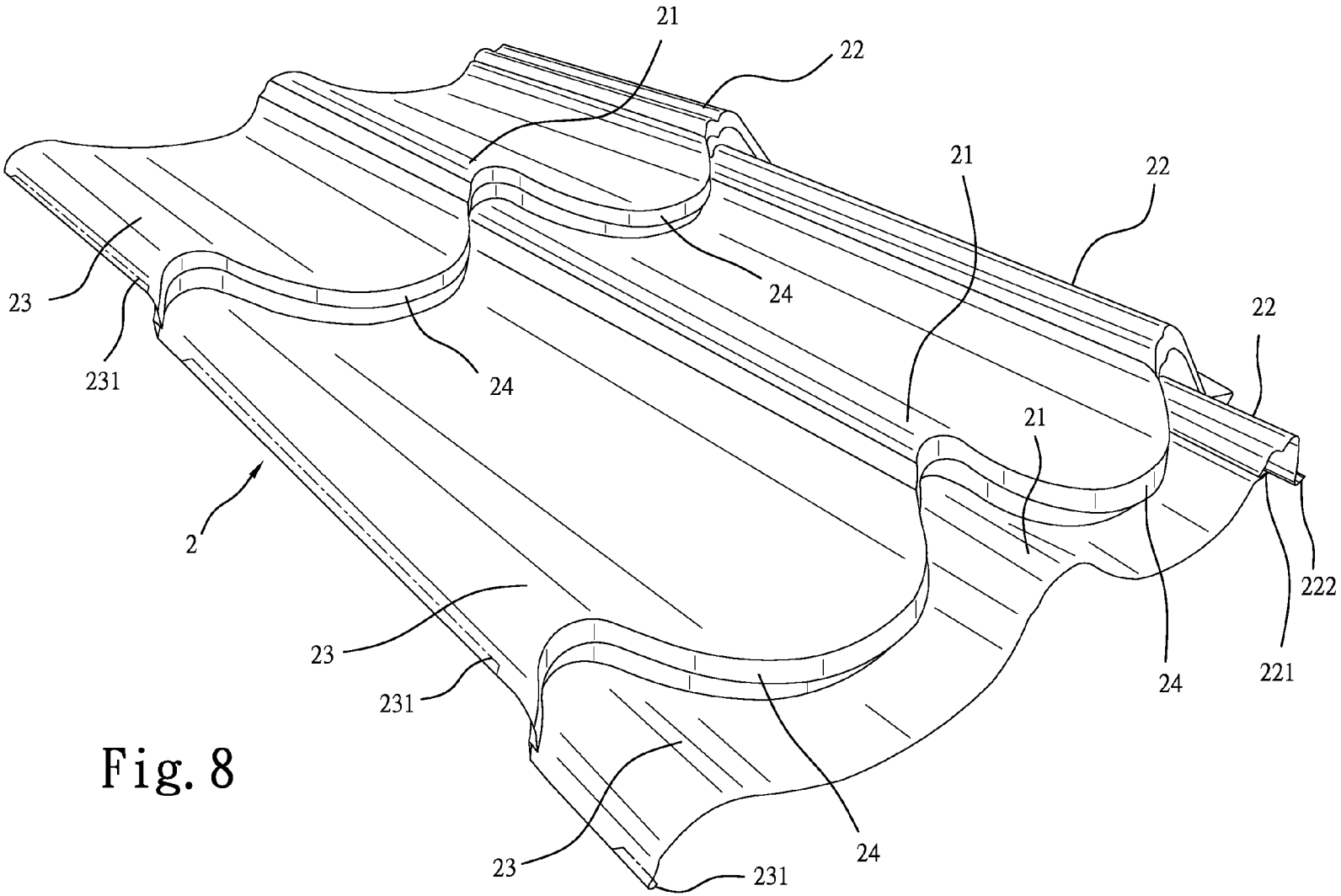
FIG. 8 is an elevational view of a finished metal sheet member made according to the present invention.
Figure 9:
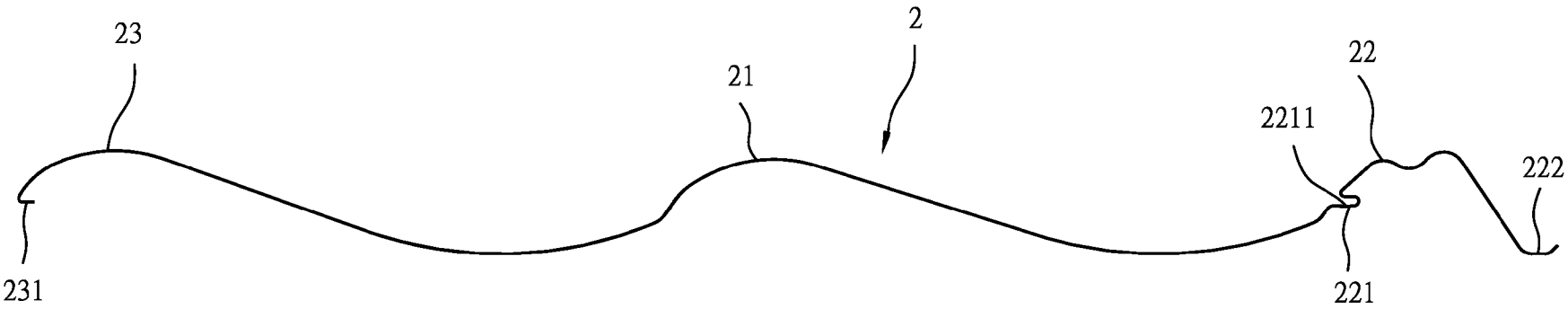
FIG. 9 is a transverse cross section of a finished metal sheet member made according to the present invention.
Figure 10:
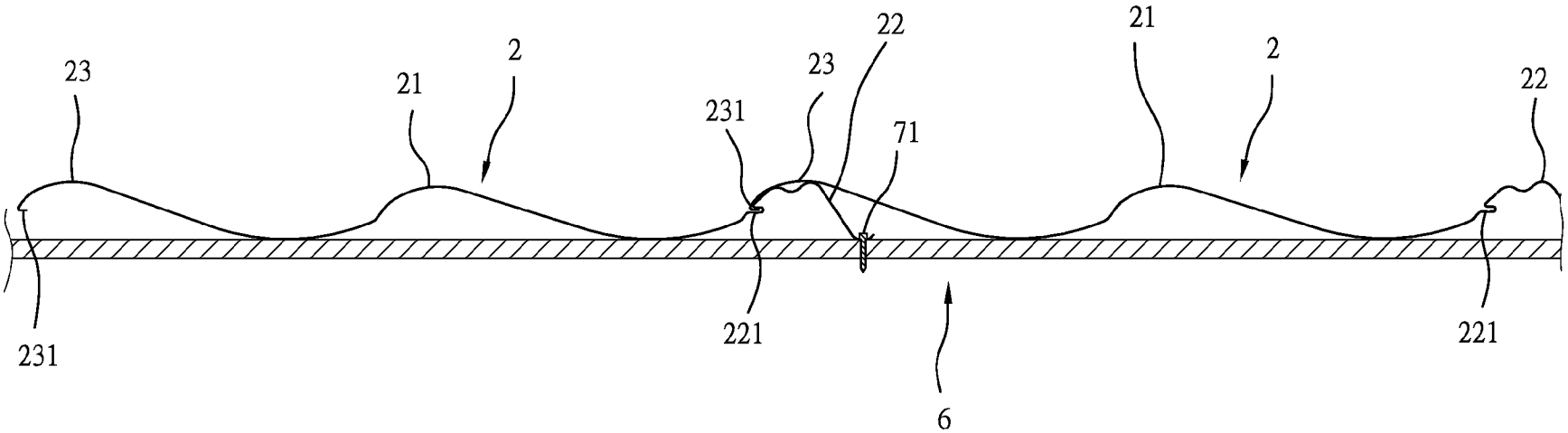
FIG. 10 is a sectional view showing two finished metal sheet members overlapped and affixed to a metal frame according to the present invention.
Figure 11:
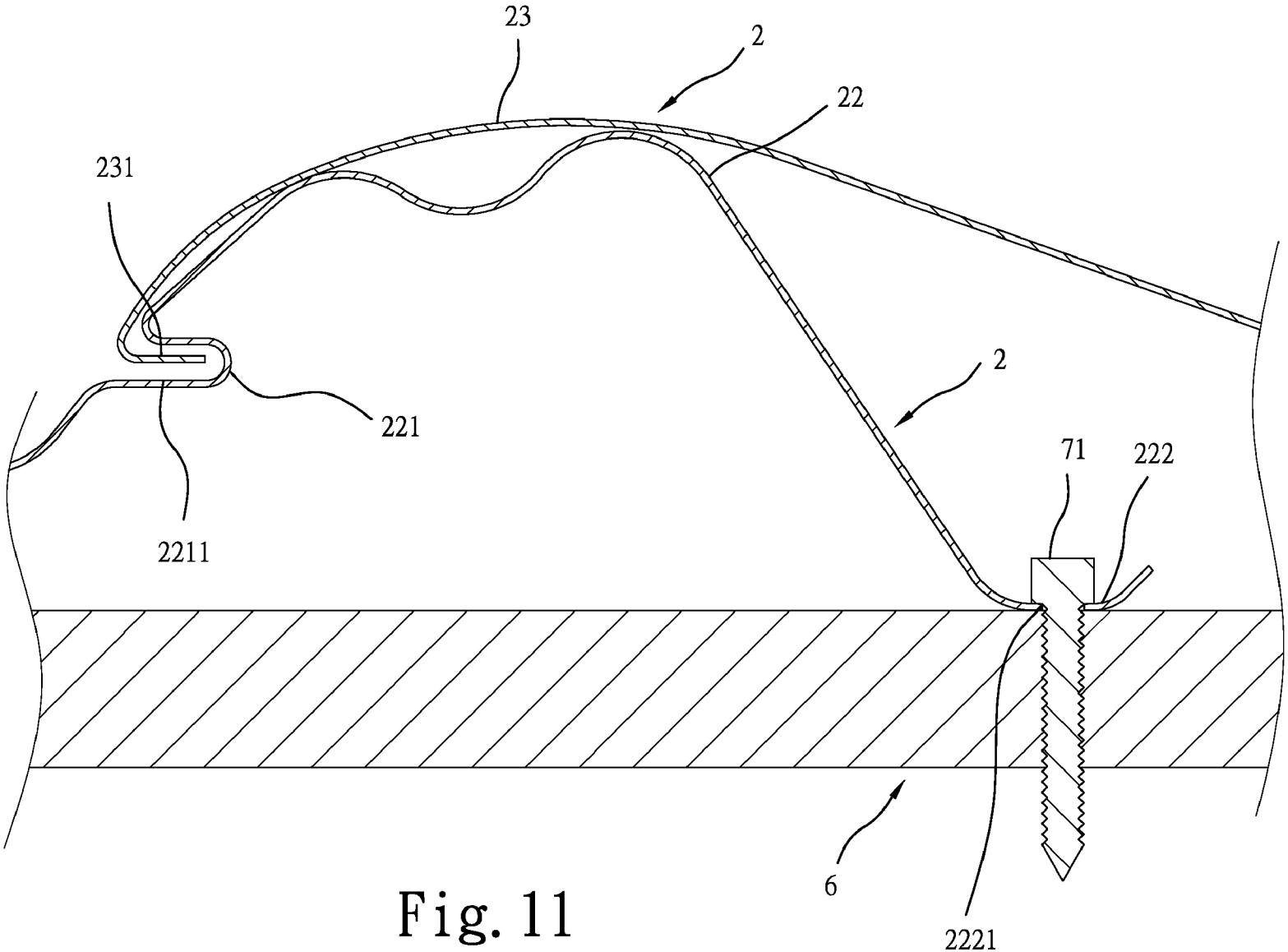
FIG. 11 is a sectional view in an enlarged scale of a part of FIG. 10, showing the mounting screw at one corrugated metal sheet member kept beneath the lateral corrugated portion at the right side of the other corrugated metal sheet member.
Figure 12:
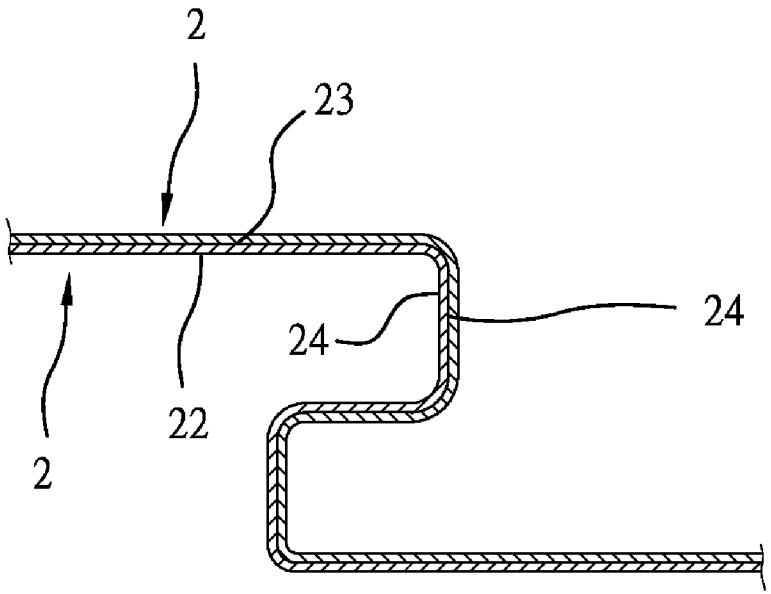
FIG. 12 is a sectional view of the overlapped part of two corrugated metal sheet members affixed according to the present invention.

The invention is characterized that the roller ramming unit 4 comprises a flange-forming roller set 42 located on the machine base 3 near the rear side thereof (see FIGS. 5 and 6) for ramming a part of the opposite lateral corrugated portion 22 of each corrugated metal sheet member 2 into an inwardly protruding bottom flange 231, a flange cutting tool 43 located on the machine base 3 behind the flange-forming roller set 42 (see FIG. 7) for cutting the inwardly protruding bottom flange 231 subject to the desired length and shape, a stamping mold 46 located on the machine base 3 behind the flange cutting tool 43 and in front of the cut-off unit 47 for stamping the lateral corrugated portion 22 of each corrugated metal sheet member 2 into a transversely curved profile 221 (see FIGS. 8~11) having a longitudinal groove 2211 and simultaneously stamping each corrugated metal sheet member 2 into a stepped configuration 24 (see FIGS. 8 and 12).

In conclusion, the corrugated metal sheet member fabrication system in accordance with the present invention has the following features and benefits:

1. When the lateral corrugated portion 22 at one lateral side of one corrugated metal sheet member 2 is overlapped on the lateral corrugated portion 23 at the right side of another corrugated metal sheet member 2, as show in FIGS. 8~12, the inwardly protruding bottom flange 231 of one lateral corrugated portion 22 is engaged into the longitudinal groove 2211 of the other corrugated metal sheet member 2 (see FIGS. 10 and 11), and at the same time the stepped configuration 24 of one corrugated metal sheet member 2 is in match with the stepped configuration 24 of the other corrugated metal sheet member 2, enhancing connection stability.

2. When a mounting screw 71 is inserted through one through hole 2221 on the lateral edge 222 of one of two overlapped corrugated metal sheet members 2 and driven into a steel frame 6 on the roof of a building (see FIGS. 10 and 11), the mounting screw 71 is kept from sight by the lateral corrugated portion 23 at the right side of another corrugated metal sheet member 2, maintaining the sense of beauty of the whole structure.

3. The formation of the transversely curved profile 221 reinforces the structural strength of the corrugated metal sheet member 2.

4. The fabrication flow is quite simple and practical for mass production.

While only one embodiment of the present invention has been shown and described, it will be understood that various modifications and changes could be made thereunto without departing from the spirit and scope of the invention disclosed.

What is claimed is:

1. A corrugated metal sheet member fabrication system comprising a roller ramming unit mounted on a machine base thereof, a metal sheet reel adapted to let off a metal sheet material through an entry guide into said roller ramming unit for enabling the fed metal sheet material to be roller-rammed by roller sets of said roller ramming unit into a corrugated form, a cut-off unit adapted to cut the corrugated metal sheet material into corrugated metal sheet members subject to the desired size, each said corrugated metal sheet member having a plurality of corrugated portions, a lateral edge at one side of a first lateral corrugated portion, dents or through holes located on said lateral edge, and a conveying unit adapted to transfer said finished corrugated metal sheet members to a predetermined location, wherein said roller ramming unit comprises a flange-forming roller set located on said machine base near a rear side thereof for ramming a part of a second lateral corrugated portion of each said corrugated metal sheet member opposite to the first lateral corrugated portion of the respective corrugated metal sheet member into an inwardly protruding bottom flange, a flange cutting tool located on said machine base behind said flange-forming roller set for cutting said inwardly protruding bottom flange subject to the desired length and shape, a stamping mold located on said machine base between said flange cutting tool and said cut-off unit for stamping the first lateral corrugated portion of each said corrugated metal sheet member into a transversely curved profile having a longitudinal groove and simultaneously stamping each said corrugated metal sheet member into a stepped configuration.

* * * * *